US010358956B1

(12) United States Patent
Egan et al.

(10) Patent No.: US 10,358,956 B1
(45) Date of Patent: Jul. 23, 2019

(54) EXHAUST VALVE AND ACTIVE NOISE CONTROL FOR COMPACT EXHAUST SYSTEM

(71) Applicant: Faurecia Emissions Control Technologies, USA, LLC, Columbus, IN (US)

(72) Inventors: James Egan, Indianapolis, IN (US); Hannes Steinkilberg, Augsburg (DE); Yuntian Wang, Columbus, IN (US); Brandon Sobecki, Columbus, IN (US); Subhabrata Banerjee, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days.

(21) Appl. No.: 16/029,807

(22) Filed: Jul. 9, 2018

(51) Int. Cl.
*F01N 1/06* (2006.01)
*G10K 11/178* (2006.01)
*F01N 1/16* (2006.01)

(52) U.S. Cl.
CPC ..... *F01N 1/065* (2013.01); *G10K 11/17823* (2018.01); *F01N 1/16* (2013.01); *F01N 1/166* (2013.01); *F01N 2210/06* (2013.01); *G10K 2210/112* (2013.01); *G10K 2210/12822* (2013.01); *G10K 2210/3044* (2013.01)

(58) Field of Classification Search
CPC ..... F01N 1/065; F01N 2210/06; F01N 1/16; F01N 1/166; G10K 11/17823; G10K 2210/12822; G10K 2210/3044; G10K 2210/112
See application file for complete search history.

(56) References Cited

U.S. PATENT DOCUMENTS

| | | | | |
|---|---|---|---|---|
| 6,454,047 | B1 | 9/2002 | Galaitsis | |
| 6,633,646 | B1 * | 10/2003 | Hwang | G10K 11/175 181/206 |
| 6,938,729 | B2 | 9/2005 | Wörner et al. | |
| 7,703,574 | B2 | 4/2010 | Krüger et al. | |
| 8,365,522 | B2 | 2/2013 | Abram et al. | |
| 8,857,561 | B2 * | 10/2014 | Abram | F01N 1/065 181/254 |
| 9,121,321 | B2 | 9/2015 | Terrell | |
| 9,706,295 | B2 * | 7/2017 | Pommerer | H04R 3/002 |
| 2009/0255754 | A1 | 10/2009 | Kruger et al. | |
| 2010/0043398 | A1 | 2/2010 | Abram et al. | |
| 2017/0362976 | A1 * | 12/2017 | Solferino | F01N 13/02 |
| 2018/0016954 | A1 * | 1/2018 | Eichmueller | F01N 1/003 |

* cited by examiner

*Primary Examiner* — Andrew L Sniezek
(74) *Attorney, Agent, or Firm* — Carlson, Gaskey & Olds, P.C.

(57) ABSTRACT

A vehicle exhaust system includes a first exhaust gas path and a second exhaust gas path. At least one valve is positioned within the first exhaust gas path and an active noise control system is associated with the second exhaust gas path. An example method includes, providing the first exhaust gas path with a first tailpipe having a first outlet and the second exhaust gas path with a second tailpipe having a second outlet separate from the first outlet. The valve and the active noise control system are controlled simultaneously to control noise generated by the vehicle exhaust system.

20 Claims, 3 Drawing Sheets

EXHAUST VALVE AND ACTIVE NOISE CONTROL FOR COMPACT EXHAUST SYSTEM

TECHNICAL FIELD

This invention generally relates to a dual path vehicle exhaust system having active noise control and a valve to control noise in a compact configuration.

BACKGROUND OF THE INVENTION

Active noise control (ANC) systems are used in many vehicle exhaust systems to control the level of sound emitted by the exhaust system. Integrating an ANC system into a vehicle exhaust system is an attractive way to achieve a lower weight in a smaller packaging area, and can provide a system that can potentially out-perform traditional exhaust systems in terms of back pressure and tailpipe noise reduction. Additionally ANC systems are beneficial because they can add noise as well as cancel noise.

Noise attenuation difficulties arise for controlling low frequency noise, such as noise below 80 HZ, for example. To effectively cancel low frequency noise, a very large speaker diameter with a significantly large back volume, e.g. an increase from 3.5 L to 16 L, is required in order to effectively reduce or cancel the exhaust sound. Also, a significant amount of speaker power and/or more than one speaker may be required in order to sufficiently address all desired noise levels. This disadvantageously requires a significant amount of packaging space, and also increases cost and weight. Additionally, this causes even further issues when there is a dual tailpipe configuration.

SUMMARY OF THE INVENTION

In one exemplary embodiment, a vehicle exhaust system includes a first exhaust gas path and a second exhaust gas path. At least one valve positioned within the first exhaust gas path and an active noise control system is associated with the second exhaust gas path.

In another exemplary embodiment, a vehicle exhaust system includes a first tailpipe providing a first exhaust gas outlet and a second tailpipe providing a second exhaust gas outlet that is separate from the first exhaust gas outlet. At least one valve is positioned within the first tailpipe and an active noise control system is associated with the second tailpipe. The active noise control system includes at least one speaker and microphone, and at least one controller manages the at least one valve and the active noise control system.

In another exemplary embodiment, a method of controlling noise generated by a vehicle exhaust system comprises: providing a first tailpipe having a first outlet and a second tailpipe having a second outlet separate from the first outlet; associating at least one valve with the first tailpipe; associating an active noise control system with the second tailpipe; and controlling the valve and the active noise control system simultaneously to control noise generated by the vehicle exhaust system.

In a further embodiment of any of the above, the first exhaust gas path has a first muffler and a first tailpipe, and wherein the valve is positioned in the first tailpipe downstream of the first muffler.

In a further embodiment of any of the above, the second exhaust gas path has a second muffler and a second tailpipe, and wherein the active noise control system is associated with the second tailpipe downstream of the second muffler.

In a further embodiment of any of the above, a third muffler is positioned upstream of the first and second mufflers.

In a further embodiment of any of the above, a transverse muffler is connected to the first and second tailpipes, and wherein the valve and the active noise control system are positioned downstream of the transverse muffler.

In a further embodiment of any of the above, an additional muffler is positioned upstream of the transverse muffler, and a first pipe portion extends from the transverse muffler to the additional muffler and a second pipe portion extends from the transverse muffler to the additional muffler.

These and other features of the present invention can be best understood from the following specification and drawings, the following of which is a brief description.

DETAILED DESCRIPTION

A vehicle exhaust system 10 includes an engine 12 that generates exhaust gases that are conveyed through various components of the vehicle exhaust system 10. The exhaust system 10 includes an upstream portion that includes hot end components such as particulate filters, catalysts, e.g. SCR, DOC, etc., and other components that remove undesirable elements from the exhaust gases. The exhaust system 10 also includes a downstream portion that includes cold end components such as mufflers, resonators, X-pipes, Y-pipes, H-pipes, etc. that are used to control noise generated by the exhaust system.

Figure 1:
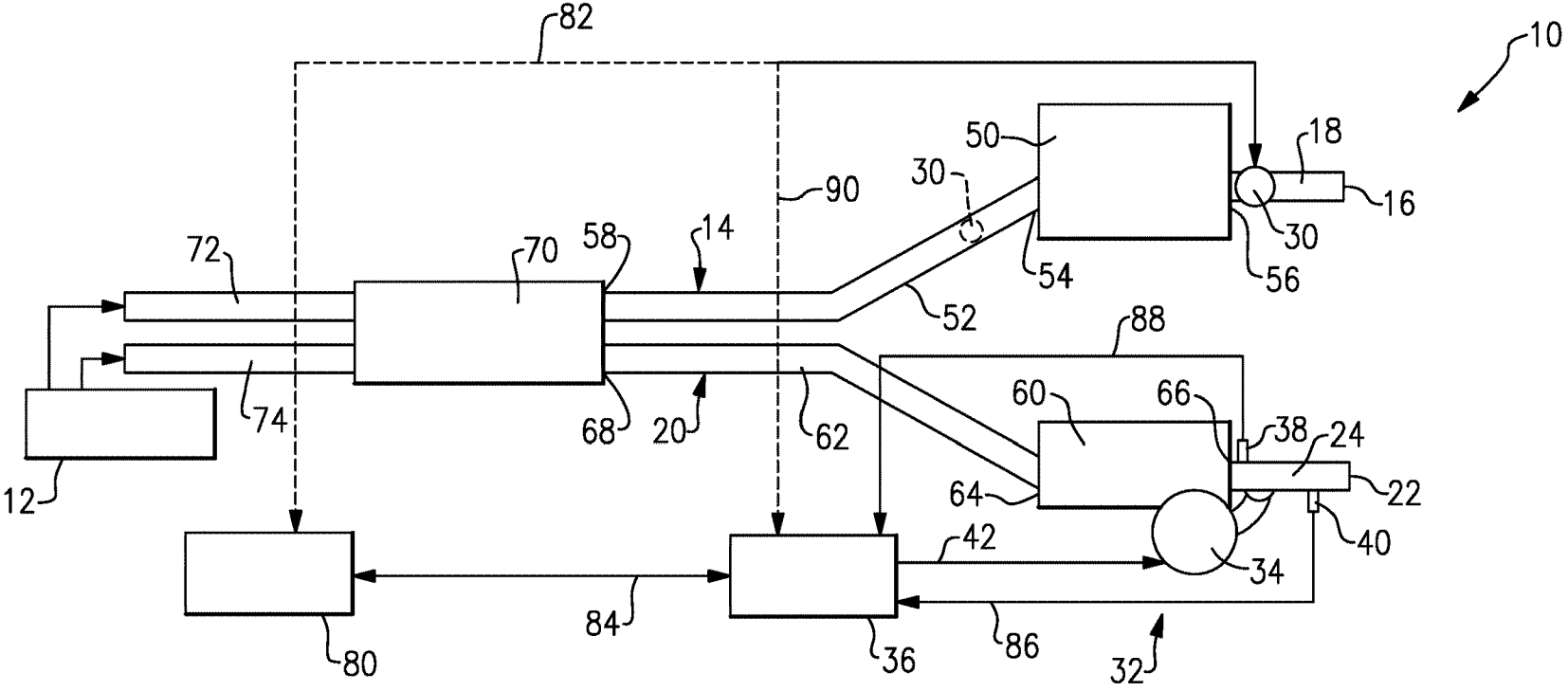
FIG. 1 is a schematic view of a vehicle exhaust system incorporating one embodiment of the subject invention.

FIG. 1 shows one example embodiment of a dual path exhaust system where a first exhaust gas path or passage 14 extends from the upstream portion of the exhaust system 10 to a first exhaust outlet 16 at a first tailpipe 18. The first exhaust gas passage 14 is comprised of one or more exhaust tubes or exhaust pipes that are connected to each other and to other exhaust system components to define the first exhaust gas passage 14 that directs exhaust gases to atmosphere via the first exhaust outlet 16. A second exhaust gas path or passage 20 extends from the upstream portion of the exhaust system 10 to a second exhaust outlet 22 at a second tailpipe 24. The second exhaust gas passage 20 is comprised of one or more exhaust tubes or exhaust pipes that are connected to each other and to other exhaust system components to define the second exhaust gas passage 20 that directs exhaust gases to atmosphere via the second exhaust outlet 22. The first 16 and second 22 exhaust gas outlets are separate from each other as shown in FIG. 1.

At least one valve 30 is positioned within the first exhaust gas passage 14 and an active noise control system 32 is associated with the second exhaust gas passage 20. In one example, the valve 30 is positioned within the first exhaust gas passage 14 in a non-bypass configuration such that all exhaust gas must pass through the valve 30 before exiting the first exhaust outlet 16. The valve 30 and active noise control system 32 cooperate with each other to control noise generated by the exhaust system 10.

Any type of active noise control system 32 can be used within the vehicle exhaust system 10; however, the active noise control system 32 must be able to provide active sound cancelling and/or sound enhancement. In one example, the active noise control system 32 includes a speaker 34 and an anti-noise controller 36. The active noise control system 32 may optionally include one or more sensors 38 and/or a microphone 40 that communicates exhaust or sound characteristics to the controller 36. The anti-noise controller 36 then generates a control signal 42 that causes the speaker 34 to generate an out of phase sound that cancels out an exhaust system generated noise as known. Optionally, the control signal 42 can cause the speaker 34 to generate a sound that is used to enhance noise to provide a desired noise level.

In the example configuration of FIG. 1, the first exhaust gas passage 14 includes a first muffler 50 having a first exhaust pipe portion 52 that comprises an inlet 54 to the first muffler 50. The first tailpipe 18 is connected to an outlet 56 from the first muffler 50. The second exhaust gas path 20 includes a second muffler 60 having a second exhaust pipe portion 62 that comprises an inlet 64 to the second muffler 60. The second tailpipe 24 is connected to an outlet 66 from the second muffler 60. In this example, an additional third muffler 70 is located upstream of the first 50 and second 60 mufflers. The first exhaust pipe portion 52 extends from the first muffler 50 to a first outlet 58 of the third muffler 70 and the second exhaust pipe portion 62 extends from the second muffler 60 to a second outlet 68 of the third muffler 70. A third exhaust pipe portion 72 of the first exhaust gas passage 14 extends from the third muffler 70 to upstream exhaust components, and a fourth exhaust pipe portion 74 of the second exhaust gas passage 20 extends from the third muffler 70 to upstream exhaust components. In configurations where there is not a third muffler, other connecting elements could be used such as X-pipes, Y-pipes, H-pipes, for example.

The valve 30 is comprised of a valve body that is positioned within the first tailpipe 18 downstream of the first muffler 50. Optionally, the valve 30 could be upstream of the first muffler 50 (see dashed lines in FIG. 1), or additional valves could be included as needed to achieve the desired noise attenuation. In one example, the valve 30 comprises a single valve in the first exhaust passage 14 and is the only valve located within the tailpipe 18. In one example, the valve 30 is controlled by an engine control unit 80, or a separate dedicated valve control unit, and is moveable through various positions between a closed position where a maximum portion of the passage 14 is blocked by the valve 30 and an open position where there is maximum flow through the first exhaust gas passage 14. The engine control unit 80 generates a control signal 82 to control movement of the valve 30.

The active noise control system 32 is associated with the second tailpipe 24 downstream of the second muffler 60. This configuration allows for the second muffler 60 to be smaller than the first muffler 50, which provides for an even more compact arrangement. The microphone 40 sends feedback 86 to the anti-noise controller 36. The sensor(s) 38, such as a temperature sensor for example, also sends data back to the anti-noise controller 36 as indicated at 88. Information regarding valve position in the first exhaust gas passage 14 can also be communicated to the anti-noise controller 36 as indicated at 90.

The engine control unit/valve control unit 80 and the anti-noise controller 36 communicate with each other, as indicated at 84, to control the valve 30 and speaker 34 to simultaneously control noise within the first 14 and second 20 exhaust gas passages by attenuating low and/or high frequency noise, respectively, as needed. The engine control unit 80 can be a separate controller from the controller 36 for the active noise control system 32, or optionally, the controllers could be combined with each other as a single unit. The controllers 36 and/or 80 can also use additional information such as engine RPM, throttle position, desired noise profile, engine mode, or any other engine or exhaust system characteristics, to control the position of the valve 30 and/or the speaker output to achieve the desired noise configuration.

The system operates as follows. At low exhaust flow rates, the valve 30 is closed. This significantly improves the low frequency acoustics of the exhaust system 10. This also enables the single speaker 34 attached to the second tailpipe 24 to cancel the remaining engine noise after passing through the upstream portion of the exhaust system 10. To enable the cancellation of the engine noise emitted from the second tailpipe 24, the error microphone measures the residual noise and feeds this information to the anti-noise controller 36. The anti-noise controller 36 additionally uses inputs from the engine control unit 80 of engine speed, load, and optionally other additional data as described above, to modify the input control signal 42 to the speaker 34.

The actively controlled valve 30 is opened, or moved progressively toward the open position, in order to keep the system back pressure within acceptable levels. At some point, as the valve 30 opens, the noise emitted from the first tailpipe 18 will be louder than the noise emitted by the second tailpipe 24. At this point, noise cancellation is no longer effective and the valve 30 is controlling the minimum noise level as opposed to the speaker 34. Thus, the active noise control only works when the valve 30 is closed and up to the point where the noise emitted from the first tailpipe 18 will be louder than the noise emitted by the second tailpipe 24. As such, by combing an active valve 30 with active noise control, a lower cost system for a dual exhaust path can be achieved as compared to a two speaker system.

In addition to cancellation, noise addition is also possible. This possibility can occur simultaneously, e.g. one could cancel one frequency while enhancing another frequency. This makes it possible to cancel, for example, second and fourth EOs while enhancing 1.5, 3, and 6 EOs, which makes and I4 engine sound more like a V6 engine.

Figure 2:
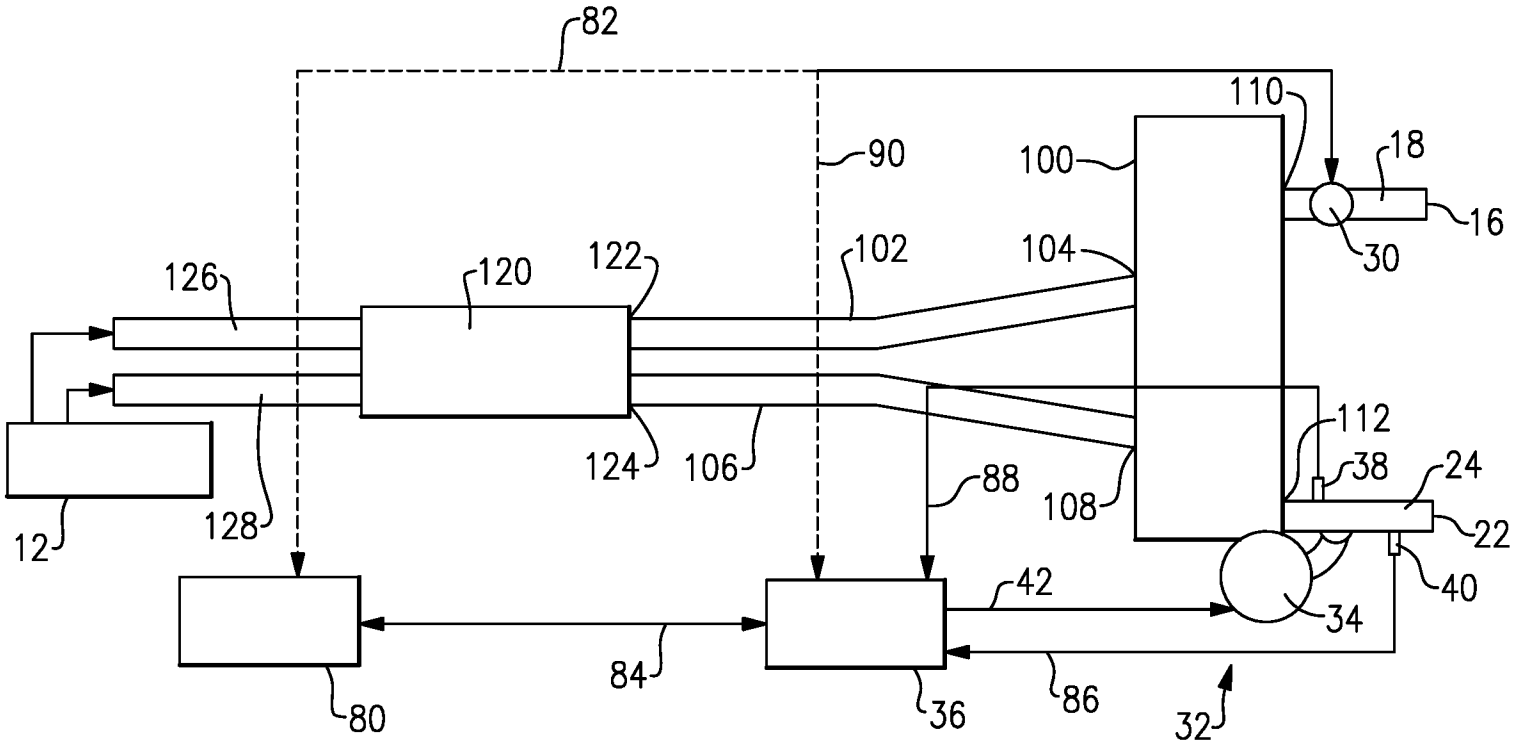
FIG. 2 is a schematic view of another embodiment that utilizes a transverse muffler.

FIG. 2 shows a configuration similar to FIG. 1; however, in this configuration the separate first 50 and second 60 mufflers are replaced by a single transverse muffler 100 that is connected to both the first 18 and second 24 tailpipes. The first exhaust gas passage 14 includes a first pipe portion 102 that is connected to a first inlet 104 to the transverse muffler and the second exhaust gas passage 20 includes a second pipe portion 106 that is connected to a second inlet 108 of the transverse muffler 100. The transverse muffler 100 has a first outlet 110 connected to the first tailpipe 18 and a second outlet 112 connected to the second tailpipe 24. The first 14 and second 20 exhaust gas passages remain discrete passage from teach other with separate outlets to atmosphere but are connected to each other via the downstream transverse muffler 100. Further, the valve 30 is located in the first tailpipe 18 and the active noise control system 32 is associated with the second tailpipe 24 in a manner as discussed above with regard to FIG. 1.

Optionally, an upstream muffler 120 is connected to the first 14 and second 20 exhaust gas passages upstream of the transverse muffler 100. The first pipe portion 102 extends to a first outlet 122 of the upstream muffler 120 and the second pipe portion 106 extends to a second outlet 124 of the upstream muffler 120. A third pipe portion 126 of the first exhaust gas passage 14 extends from the upstream muffler 120 to upstream exhaust components and a fourth pipe portion 128 of the second exhaust gas passage 20 extends from the upstream muffler 120 to upstream exhaust components.

Figure 3:
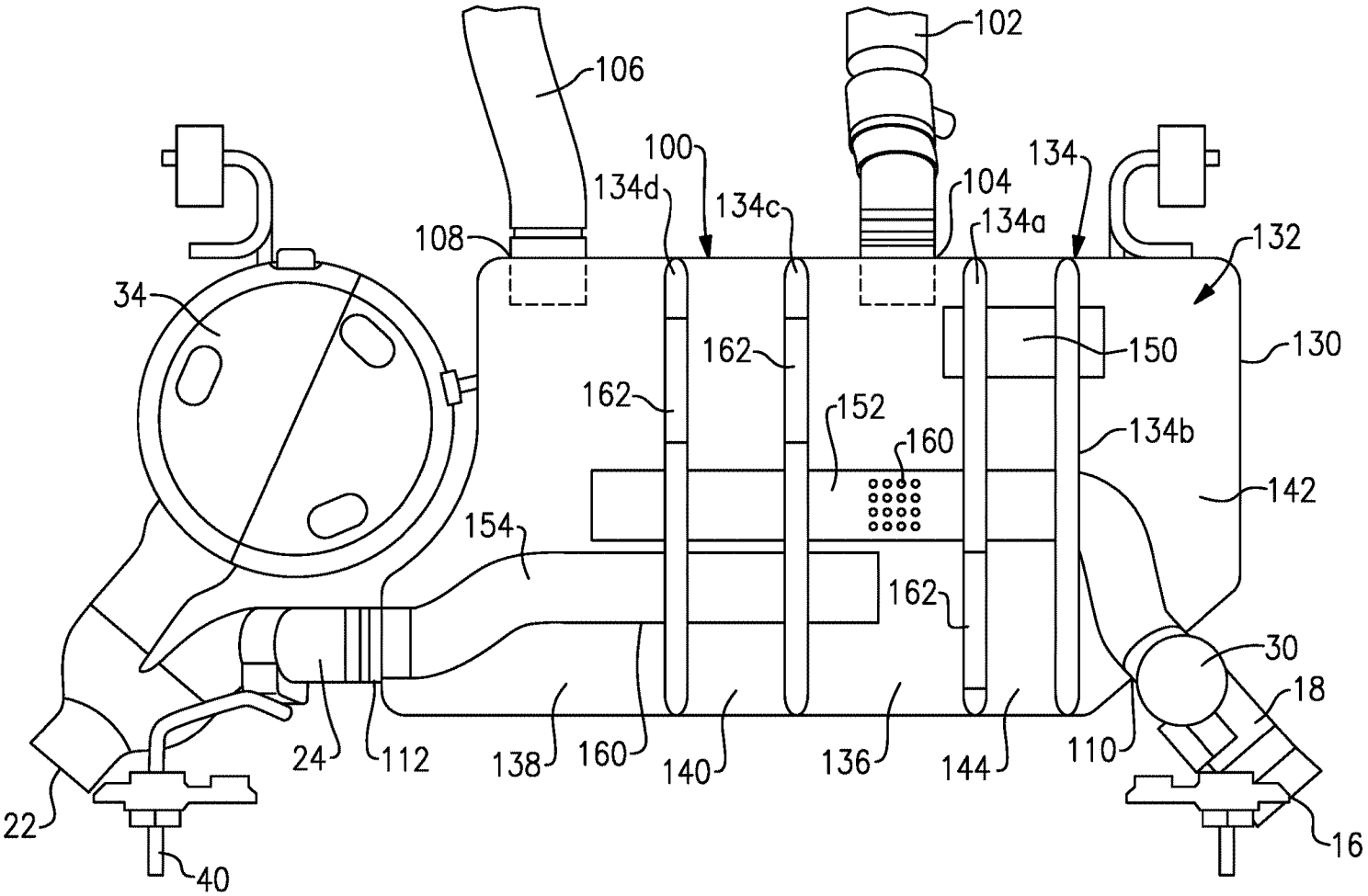
FIG. 3 is a more detailed view of the transverse muffler of FIG. 2.

One example of the transverse muffler 100 is shown in greater detail in FIG. 3. In this example, the transverse muffler 100 includes an outer housing 130 enclosing an open internal cavity 132. A plurality of baffle plates 134 are located within the cavity 132 to divide the cavity 132 into multiple chambers. The first inlet 104 communicates with a first chamber 136 and the second inlet 108 communicates with a second chamber 138. A third separate chamber 140 is positioned axially between the first 136 and second 138 chambers. The first outlet 110 is associated with a fourth chamber 142. A fifth chamber 144 is positioned axially between the fourth chamber 142 and the first chamber 136. The second outlet 112 is associated with the second chamber 138.

In this example, a first pipe 150 is supported by first and second baffle plates 134*a*, 134*b* to extend through the fifth chamber 144. The first pipe 150 has a first end that is open to the fourth chamber 142 and a second, opposite, end that is open to the first chamber 136. A second pipe 152 is supported by the first 134*a* and second 134*b* baffle plates, as well as by third 134*c* and fourth 134*d* baffle plates, to extend through the first 136, third 140, and fifth 144 chambers. The second pipe 152 has a first end that is open to the second chamber 138 and a second, opposite end comprises the first outlet 110. A third pipe 154 is supported by the third 134*c* and fourth 134*d* baffle plates to extend through the third chamber 140. The third pipe 154 has a first end that is open to the first chamber 136 and a second, opposite, end comprises the second outlet 112.

The first 150, second 152, and/or third 154 pipe portions may include perforated sections 160 to provide further noise attenuation as needed. The baffle plates 134 may comprise solid plates with openings for the respective pipe portions 150, 152, 154. Or, one or more of the baffle plates 134 may include sections 162 with perforations and/or other noise reducing materials.

The use of the valve 30 in first exhaust gas passage 14 of the exhaust system allows the exhaust sound emitted from this passage to be substantially deliminated. This means the active noise control system 32 need only address the noise emitted from the muffler 60. Because one of the exhaust outlets is addressed by the valve, the active noise control system can use a single "driver", e.g. a speaker, for noise cancelling a dual outlet system. Additionally, there are some low frequency benefits of using a valve in this configuration that enables a smaller, lighter, and less expensive speaker to be utilized.

Further, by combining the active noise control system 32 in one path of a dual path exhaust configuration with the valve 30 located within the other path of the dual path exhaust configuration, it allows the overall size of the active noise control system 32 to be made very compactly. Further, by reducing the size, the energy required to power the active noise control system 32 can be significantly reduced. Also, by using only one valve 30 and one active noise control system 32 to control noise in a dual path configuration, the overall size of the exhaust system 10 can be reduced to provide a more compact arrangement.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

at least one first muffler;

at least one second muffler downstream of the at least one first muffler;

a first exhaust gas path extending to a first outlet at a first tailpipe and comprising a first pipe having one end connected to the at least one first muffler and an opposite end connected to the at least one second muffler in a non-bypass configuration;

a second exhaust gas path extending to a second outlet at a second tailpipe and comprising a second pipe having one end connected to the at least one first muffler and an opposite end connected to the at least one second muffler in a non-bypass configuration;

at least one valve positioned within the first exhaust gas path; and an active noise control system associated with the second exhaust gas path.

2. The vehicle exhaust system according to claim 1 wherein the first exhaust gas path is separate from the second exhaust gas path.

3. The vehicle exhaust system according to claim 1 wherein the valve is positioned in the first tailpipe.

4. The vehicle exhaust system according to claim 1 wherein the active noise control system is associated with the second tailpipe.

5. The vehicle exhaust system according to claim 1 wherein the at least one second muffler comprises at least two second mufflers, and wherein the first exhaust gas path has one of the two second mufflers and includes the first tailpipe, and wherein the valve is positioned in the first tailpipe downstream of the one of the two second mufflers.

6. The vehicle exhaust system according to claim 5 wherein the second exhaust gas path has the other of the two second mufflers and includes the second tailpipe, and wherein the active noise control system is associated with the second tailpipe downstream of the other of the two second mufflers.

7. The vehicle exhaust system according to claim 1 wherein the valve is actively controlled by a controller to move between a plurality of positions within the first exhaust gas path.

8. The vehicle exhaust system according to claim 1 wherein the active noise control system includes at least one speaker, at least one microphone, and a controller that generates a control signal that is communicated to the speaker.

9. The vehicle exhaust system according to claim 8 wherein the first outlet and the second outlet form a dual outlet system, and wherein the at least one valve comprises a single valve and the active noise control system includes a single speaker that cooperates with the single valve to delimit and/or cancel emitted sound from the dual outlet system.

10. A vehicle exhaust system comprising:

a first exhaust gas path having a first muffler and a first tailpipe;

a second exhaust gas path having a second muffler and a second tailpipe;

at least one valve positioned within the first exhaust gas path, wherein the at least one valve is positioned in the first tailpipe downstream of the first muffler; and an active noise control system associated with the second exhaust gas path, wherein the active noise control system is associated with the second tailpipe downstream of the second muffler, and wherein the second muffler is smaller than the first muffler.

11. A vehicle exhaust system comprising:

a first exhaust gas path;

a second exhaust gas path wherein the first exhaust path includes a first tailpipe and the second exhaust gas path includes a second tailpipe;

at least one valve positioned within the first exhaust gas path;

an active noise control system associated with the second exhaust gas path; and a muffler that is connected to the first and second tailpipes, and wherein the valve and the active noise control system are positioned downstream of the muffler.

12. A vehicle exhaust system comprising:

a first tailpipe providing a first exhaust gas outlet;

a second tailpipe providing a second exhaust gas outlet separate from the first exhaust gas outlet;

at least one valve positioned within the first tailpipe;

an active noise control system associated with the second tailpipe, wherein the active noise control system includes at least one speaker and microphone; and at least one controller to control the at least one valve and the active noise control system.

13. The vehicle exhaust system according to claim 12 including a first muffler connected to the first tailpipe and a second muffler connected to the second tailpipe, and wherein the valve is positioned in the first tailpipe downstream of the first muffler and the active noise control system is associated with the second tailpipe downstream of the second muffler.

14. The vehicle exhaust system according to claim 13 wherein the first muffler is larger than the second muffler.

15. The vehicle exhaust system according to claim 13 including a third muffler positioned upstream of the first and second mufflers, and including a first pipe portion that extends from the first muffler to the third muffler and a second pipe portion that extends from the second muffler to the third muffler.

16. The vehicle exhaust system according to claim 12 including a transverse muffler that is connected to the first and second tailpipes, and wherein the valve and the active noise control system are positioned downstream of the transverse muffler.

17. The vehicle exhaust system according to claim 16 including an additional muffler positioned upstream of the transverse muffler, and including a first pipe portion that extends from the transverse muffler to the additional muffler and a second pipe portion that extends from the transverse muffler to the additional muffler.

18. A method of controlling noise generated by a vehicle exhaust system comprising the steps of:

providing at least one first muffler and at least one second muffler positioned downstream of the first muffler;

connecting one end of a first pipe to the at least one first muffler and an opposite end to the at least one second muffler in a non-bypass configuration to form a first exhaust gas path;

connecting one end of a second pipe to the at least one first muffler and an opposite end to the at least one second muffler in a non-bypass configuration to form a second exhaust gas path;

providing a first tailpipe having a first outlet and a second tailpipe having a second outlet separate from the first outlet;

associating at least one valve with the first tailpipe;

associating an active noise control system with the second tailpipe; and controlling the valve and the active noise control system simultaneously to control noise generated by the vehicle exhaust system.

19. The method according to claim 18 wherein one of the two second mufflers comprises at least two second mufflers, and wherein the first exhaust gas path has the at least one second muffler and the first tailpipe, and including positioning the valve in the first tailpipe downstream of the one of the two second mufflers.

20. The method according to claim 19 wherein the second exhaust gas path has the other of the two second mufflers and the second tailpipe, and including associating the active noise control system with the second tailpipe downstream of the other of the two second mufflers.

* * * * *